US006202746B1

(12) United States Patent
Vandenberg et al.

(10) Patent No.: US 6,202,746 B1
(45) Date of Patent: Mar. 20, 2001

(54) FAIL-SAFE COUPLING FOR A LATCH ASSEMBLY

(75) Inventors: Elis Vandenberg, Sherwood Park; Ian G. Gillis; Laurier E. Comeau, both of Leduc, all of (CA)

(73) Assignee: Dresser Industries, Inc., Dallas, TX (US)

( * ) Notice: Subject to any disclaimer, the term of this patent is extended or adjusted under 35 U.S.C. 154(b) by 0 days.

(21) Appl. No.: 09/158,840

(22) Filed: Sep. 23, 1998

(30) Foreign Application Priority Data

Sep. 22, 1998 (CA) ..... 2248287

(51) Int. Cl.[7] ..... E21B 7/08
(52) U.S. Cl. ..... 166/117.6; 166/237
(58) Field of Search ..... 166/117.5, 117.6, 166/255.2, 255.3, 242.1, 214, 237, 206, 208, 209

(56) References Cited

U.S. PATENT DOCUMENTS

| | | | |
|---|---|---|---|
| 1,851,319 | 3/1932 | McCoy et al. | 166/255 |
| 2,862,564 | 12/1958 | Hostock | 166/214 |
| 3,070,166 | 12/1962 | Knauth | 166/255 |
| 3,130,788 | 4/1964 | Cochran et al. | 166/217 |
| 3,143,170 | 8/1964 | Nelson | 166/255 |
| 3,208,531 | 9/1965 | Tamplen | 166/125 |
| 3,430,699 | 3/1969 | De Cuir | 166/217 |
| 4,023,620 | 5/1977 | Gazda et al. | 166/217 |
| 4,161,984 | 7/1979 | Watkins | 166/208 |
| 4,164,977 | 8/1979 | Arendt et al. | 166/125 |
| 4,167,970 | 9/1979 | Cowan | 166/208 |
| 4,369,840 | 1/1983 | Szarka et al. | 166/214 |
| 4,396,061 | 8/1983 | Tamplen et al. | 166/217 |
| 4,415,205 | 11/1983 | Rehm et al. | 166/117.5 |
| 4,457,368 | 7/1984 | Knierimen et al. | 166/217 |
| 4,628,998 | 12/1986 | Akkerman | 166/237 |
| 4,896,721 | 1/1990 | Welch | 166/214 |
| 4,944,345 | 7/1990 | Mashaw, Jr. | 166/206 |
| 4,986,362 | 1/1991 | Pleasants | 166/382 |
| 5,348,087 | 9/1994 | Williamson, Jr. | 166/115 |
| 5,390,742 | 2/1995 | Dines et al. | 166/297 |
| 5,579,829 | 12/1996 | Comeau et al. | 166/117.6 |
| 5,778,980 * | 7/1998 | Comeau et al. | 166/298 |
| 5,996,711 * | 12/1999 | Ohmer | 175/61 |

FOREIGN PATENT DOCUMENTS

| | | |
|---|---|---|
| 2120311 | 10/1994 | (CA) . |
| 2217356 * | 9/1997 | (CA) . |
| 0834643A2 | 4/1998 | (EP) . |

* cited by examiner

*Primary Examiner*—Frank Tsay
(74) *Attorney, Agent, or Firm*—Paul I. Herman; Terrence N. Kubarchuk

(57) ABSTRACT

A fail-safe tubular receiving member for use in combination with a latch assembly to longitudinally support and rotationally orient the latch assembly in a wellbore. The latch assembly includes at least one outwardly biased, radially movable latch member which is receivable within a bore of the receiving member. A first recessed area and a second recessed area, accessible from the first recessed area, are defined by the bore. The first recessed area defines a first increased radial distance and is configured so that upon longitudinal alignment of the latch member and the first recessed area, the latch member moves radially outward for receipt in the first recessed area to support the latch assembly longitudinally such that longitudinal movement of the latch assembly relative to the receiving member further downhole is prevented. The second recessed area defines a second increased radial distance, greater than the first increased radial distance, and is configured so that upon rotational alignment of the latch member and the second recessed area, the latch member moves radially outward for receipt in the second recessed area to orient the latch assembly rotationally such that rotation of the latch assembly relative to the receiving member is inhibited.

26 Claims, 4 Drawing Sheets

FAIL-SAFE COUPLING FOR A LATCH ASSEMBLY

FIELD OF INVENTION

The present invention relates to a fail-safe tubular receiving member, preferably a coupling, for use in combination with a latch assembly for longitudinally supporting and rotationally orienting the latch assembly in a wellbore at a location beneath the surface. Further, the invention relates to a fail-safe apparatus for longitudinally supporting and rotationally orienting a well tool in the wellbore, wherein the apparatus is comprised of the latch assembly for connection with the tool and the tubular receiving member.

BACKGROUND OF INVENTION

Current drilling technology, including directional drilling technology, permits the drilling of conventional vertical wellbores which are substantially perpendicular to the ground surface, as well as deviated or non-vertical wellbores. Directional drilling technology also allows for branch, lateral or secondary wellbores to be drilled laterally from a main or primary wellbore. Lateral wellbores are often drilled and produced through a gap in the casing of the main wellbore. This gap typically comprises a window cut or milled in a section of the existing casing string. The lateral wellbore tends to extend laterally from the main wellbore to a desired location within the formation.

In order to drill and produce such lateral wellbores, it is necessary for downhole drilling and production tools to be capable of being located and oriented downhole. First, the downhole tool must be capable of being located at the desired depth beneath the surface. In particular, the downhole tool is preferably able to be located at or adjacent the window in the casing for the lateral wellbore. Second, in order that the tool may be diverted in the desired direction, such as for the drilling or re-entry of the lateral wellbore, the tool is also preferably able to be oriented within the wellbore in a desired direction.

Conventional downhole landing systems typically include one or more landing nipples spaced apart in a wellbore. These landing nipples provide internal profiled recesses which are compatible with the external profile of a corresponding lock mandrel or latch which is connectable to or forms a part of a downhole tool. Matching of the profiles on the landing nipple and the lock mandrel acts to locate the tool longitudinally within the wellbore at a desired location downhole. However, these conventional landing systems may not provide for or permit the downhole tool to be oriented in a desired manner relative to a lateral wellbore. Thus, these systems have limited application to the drilling or production of lateral wellbores.

For example, conventional downhole landing and locating systems are shown in U.S. Pat. No. 5,348,087 issued Sep. 20, 1994 to Williamson, Jr., U.S. Pat. No. 4,994,345 issued Jul. 31, 1990 to Mashaw Jr., U.S. Pat. No. 4,457,368 issued Jul. 3, 1984 to Knierimen et. al., U.S. Pat. No. 4,396,061 issued Aug. 2, 1983 to Tamplen et. al., U.S. Pat. No. 4,167,970 issued Sep. 18, 1979 to Cowan U.S. Pat. No. 4,164,977 issued Aug. 21, 1979 to Arendt et. al., and U.S. Pat. No. 4,023,620 issued May 17, 1977 to Gazda et. al.

As stated, it is important not only to be able to establish the depth of the downhole tool, but also to be able to establish an angular reference or orientation from which lateral wellbores may be drilled or selectively re-entered. U.S. Pat. No. 4,415,205 issued Nov. 15, 1983 to Rehm et. al. provides an indexing mechanism for both locating and orienting tools. More particularly, the indexing mechanism is comprised of an indexing dog which consists of a protrusion or internally projecting keys formed on the internal wall of the casing. The protrusion extends radially inwardly from the casing for engagement with an opening in a template associated with the downhole tool. These protrusions thus restrict the internal clearance or diameter of the casing and may therefore interfere with the work to be performed in the casing, as well as the tools which may be passed therethrough.

European Patent Application No. 0834643 published Apr. 8, 1998 also provides a method and apparatus for landing and orienting downhole tools at selected depths. More particularly, a well casing is provided with a plurality of landing and orienting joints located at selected depths. Each joint defines a differing internal landing profile and has a muleshoe therein. The muleshoe defines an upwardly facing point and an orientation slot and has helical guide ramp surfaces extending from the point to the orientation slot. The downhole tool incudes a plurality of landing dogs for engaging the landing profile of one of the joints. Further, the tool has an orientation key for guiding engagement with the helical guide ramp surfaces and orienting engagement with the orientation slot. Thus, a relatively complex structure is provided for landing and orienting the tool. Further, the structure provided for landing the tool is distinct or separate from the structure provided for orienting the tool.

U.S. Pat. No. 5,579,829 issued Dec. 3, 1996 to Comeau et. al. provides a keyless latch assembly having external surface contours compatible with a recessed area formed on the internal surface of a well casing. The recessed area is comprised of a series of grooves and slots for receiving the latch assembly therein. More particularly, upon the alignment of the latch assembly longitudinally with the grooves, the latch assembly is located at a desired depth beneath the surface. Upon the further alignment of the latch assembly rotationally with the slots, the latch assembly is oriented in a desired direction.

However, the latch assembly and grooves permit the latch assembly to be moved longitudinally in either an upwards or a downwards direction within the casing upon the application of further force to the latch assembly to overcome the engagement of the latch assembly with the grooves. Only upon the rotational alignment of the latch assembly with the slots is the latch assembly prevented from moving longitudinally in a downwards direction away from the surface. Thus, it is possible that a downhole tool fitted with the latch assembly could be accidentally dropped or pushed through the recessed area, and lost downhole, in the event the latch assembly passes through the recessed area without aligning with the slots.

Therefore, there is a need in the industry for a fail-safe or safety apparatus for longitudinally supporting and rotationally orienting a well tool in a wellbore at a location beneath the surface. Further, there is a need for a fail-safe or safety tubular receiving member for use in combination with a latch assembly to longitudinally support and rotationally orient the latch assembly in the wellbore. More particularly, there is a need for the apparatus and the receiving member to prevent the longitudinal movement of a latch assembly relative to the receiving member in a downward direction away from the surface, such that a tool fitted with the latch assembly may be located at a desired depth downhole and may not be accidentally lost downhole, while still permitting the latch assembly, and the tool connected therewith, to be oriented in a desired direction.

SUMMARY OF INVENTION

The present invention relates to a fail-safe or safety apparatus for longitudinally supporting and rotationally orienting a well tool in a wellbore at a location beneath the surface. Further, the present invention relates to a fail-safe or safety tubular receiving member or coupling forming part of the wellbore casing for use in combination with a latch assembly to longitudinally support and rotationally orient the latch assembly in the wellbore.

More particularly, the present invention relates to an apparatus and a receiving member which prevent the longitudinal movement of a latch assembly relative to the receiving member in a downward direction away from the surface. Thus, the latch assembly, and any tool fitted therewith, may be located at a desired depth downhole and may not be accidentally pushed or dropped through the receiving member. Further, the apparatus and the receiving member prevent the longitudinal movement of the latch assembly through the receiving member regardless of the orientation of the latch assembly relative to the receiving member. Once longitudinally landed in the receiving member, the latch assembly, and the tool connected therewith, may be oriented in a desired direction.

In a first aspect of the invention, the invention is comprised of a fail-safe tubular receiving member for use in combination with a latch assembly to longitudinally support and rotationally orient the latch assembly in a wellbore at a location beneath the surface, the latch assembly comprising at least one outwardly biased, radially movable latch member and the tubular receiving member defining a bore having an internal surface for receiving the latch assembly therein and a longitudinal axis extending therethrough, wherein the improvement comprises:

(a) a first recessed area defined by the internal surface of the bore of the receiving member, wherein the first recessed area defines a first increased radial distance between the longitudinal axis of the receiving member and the first recessed area and wherein the first recessed area is configured so that upon longitudinal alignment of the latch member and the first recessed area, the latch member moves radially outward and is received in the first recessed area to support the latch assembly longitudinally such that longitudinal movement of the latch assembly relative to the receiving member in a downward direction away from the surface is prevented; and (b) a second recessed area defined by the internal surface of the bore of the receiving member and accessible by the latch member from the first recessed area, wherein the second recessed area defines a second increased radial distance between the longitudinal axis of the receiving member and the second recessed area which is greater than the first increased radial distance and wherein the second recessed area is configured so that upon rotational alignment of the latch member and the second recessed area, the latch member moves radially outward and is received in the second recessed area to orient the latch assembly rotationally such that rotation of the latch assembly relative to the receiving member is inhibited.

In a second aspect of the invention, the invention is comprised of a fail-safe apparatus for longitudinally supporting and rotationally orienting a well tool in a wellbore at a location beneath the surface, comprising:

(a) a latch assembly for connection with the tool, the latch assembly comprising at least one outwardly biased, radially movable latch member;

(b) a tubular receiving member for containing within the wellbore at the location beneath the surface, wherein the tubular receiving member defines a bore for receiving the latch assembly therein, wherein the bore defines a longitudinal axis extending therethrough and wherein the bore has an internal surface;

(c) a first recessed area defined by the internal surface of the bore of the receiving member, wherein the first recessed area defines a first increased radial distance between the longitudinal axis of the receiving member and the first recessed area and wherein the first recessed area is configured so that upon longitudinal alignment of the latch member and the first recessed area, the latch member moves radially outward and is received in the first recessed area to support the latch assembly longitudinally such that longitudinal movement of the latch assembly relative to the receiving member in a downward direction away from the surface is prevented; and (d) a second recessed area defined by the internal surface of the bore of the receiving member and accessible by the latch member from the first recessed area, wherein the second recessed area defines a second increased radial distance between the longitudinal axis of the receiving member and the second recessed area which is greater than the first increased radial distance and wherein the second recessed area is configured so that upon rotational alignment of the latch member and the second recessed area, the latch member moves radially outward and is received in the second recessed area to orient the latch assembly rotationally such that rotation of the latch assembly relative to the receiving member is inhibited.

In the first and second aspects of the invention, the first recessed area extends circumferentially about the entire bore of the receiving member so that the latch assembly is capable of rotation relative to the receiving member when the latch member is received in the first recessed area. Further, the second recessed area extends circumferentially about a portion of the bore of the receiving member such that when the latch member is received in the first recessed area the latch assembly may be rotated relative to the receiving member to align the latch member rotationally with the second recessed area.

The first recessed area may have any shape, dimensions or configuration compatible with the latch assembly and the intended function of the first recessed area as described herein. More particularly, the first recessed area may have any shape, dimensions or configuration which permits the latch member to move radially outward for receipt in the first recessed area upon the longitudinal alignment of the latch member and the first recessed area and which prevents the downward movement of the latch assembly when the latch member is received in the first recessed area. In the preferred embodiment, the first recessed area is comprised of at least one groove defined by the bore of the receiving member extending about the entire circumference of the bore.

The second recessed area may also have any shape, dimensions or configuration compatible with the latch assembly and the intended function of the second recessed area as described herein. More particularly, the second recessed area may have any shape, dimensions or configuration which permits the latch member to move radially outward for receipt in the second recessed area upon the rotational alignment of the latch member and the second recessed area and which inhibits the rotation of the latch assembly relative to the receiving member when the latch member is received in the second recessed area. In the preferred embodiment, the second recessed area is comprised of at least one slot defined by the bore of the receiving member extending only partially about the circumference of the bore.

Further, the latch member comprises an external surface. The external surface of the latch member is compatible with both the first and second recessed areas such that the latch member may be received therein as described above. More particularly, the external surface of the latch member is preferably comprised of a first contour. The first recessed area is compatible with the first contour such that longitudinal movement of the latch member relative to the receiving member in a downward direction away from the surface is prevented when the latch member is received in the first recessed area. Further, the external surface of the latch member is also preferably comprised of a second contour. The second recessed area is compatible with the second contour such that rotational movement of the latch member relative to the receiving member is inhibited when the latch member is received in the second recessed area.

In the preferred embodiment, the first contour is comprised of a downwardly directed shoulder on the latch member. Further, the first recessed area is comprised of an upwardly directed shoulder in the first recessed area for engagement with the downwardly directed shoulder of the latch member upon receipt of the latch member in the first recessed area. The upwardly directed shoulder and the downwardly directed shoulder may have any shapes or configurations able to prevent the longitudinal movement of the latch member relative to the receiving member upon the engagement of the upwardly and downwardly directed shoulders. However, preferably, the downwardly directed shoulder of the latch member is substantially square and the upwardly directed shoulder of the first recessed area is substantially square so that when the latch member is received in the first recessed area the downwardly directed shoulder engages the upwardly directed shoulder to prevent longitudinal movement of the latch member relative to the receiving member.

As well, in the preferred embodiment, the second contour is comprised of sidewardly directed latch shoulders on the latch member. Further, the second recessed area is comprised of sidewardly directed recess shoulders in the second recessed area. The sidewardly directed latch shoulders and the sidewardly directed recess shoulders may have any shapes or configurations able to inhibit the rotational movement of the latch member relative to the receiving member upon the engagement of the respective sidewardly directed shoulders. However, preferably, the sidewardly directed latch shoulders of the latch member are substantially square and the sidewardly directed recess shoulders of the second recessed area are substantially square so that when the latch member is received in the second recessed area the sidewardly directed latch shoulders engage the sidewardly directed recess shoulders to inhibit rotational movement of the latch member relative to the receiving member.

The latch assembly is comprised of at least one latch member for receipt in the first and second recessed areas. However, preferably, the latch assembly is comprised of a plurality of latch members. In the preferred embodiment, the latch assembly is comprised of four latch members. Where the latch assembly is comprised of greater than one latch member, the latch members are configured on the latch assembly in a pattern and the second recessed area is configured to be compatible with the pattern of latch members so that rotational alignment of one latch member with the second recessed area will result in rotational alignment of all of the latch members with the second recessed area. Further, the rotational alignment of the latch members with the second recessed area is preferably achieved at a single rotational orientation of the latch assembly relative to the receiving member.

BRIEF DESCRIPTION OF DRAWINGS

Embodiments of the invention will now be described with reference to the accompanying drawings, in which.

DETAILED DESCRIPTION

Figure 1:
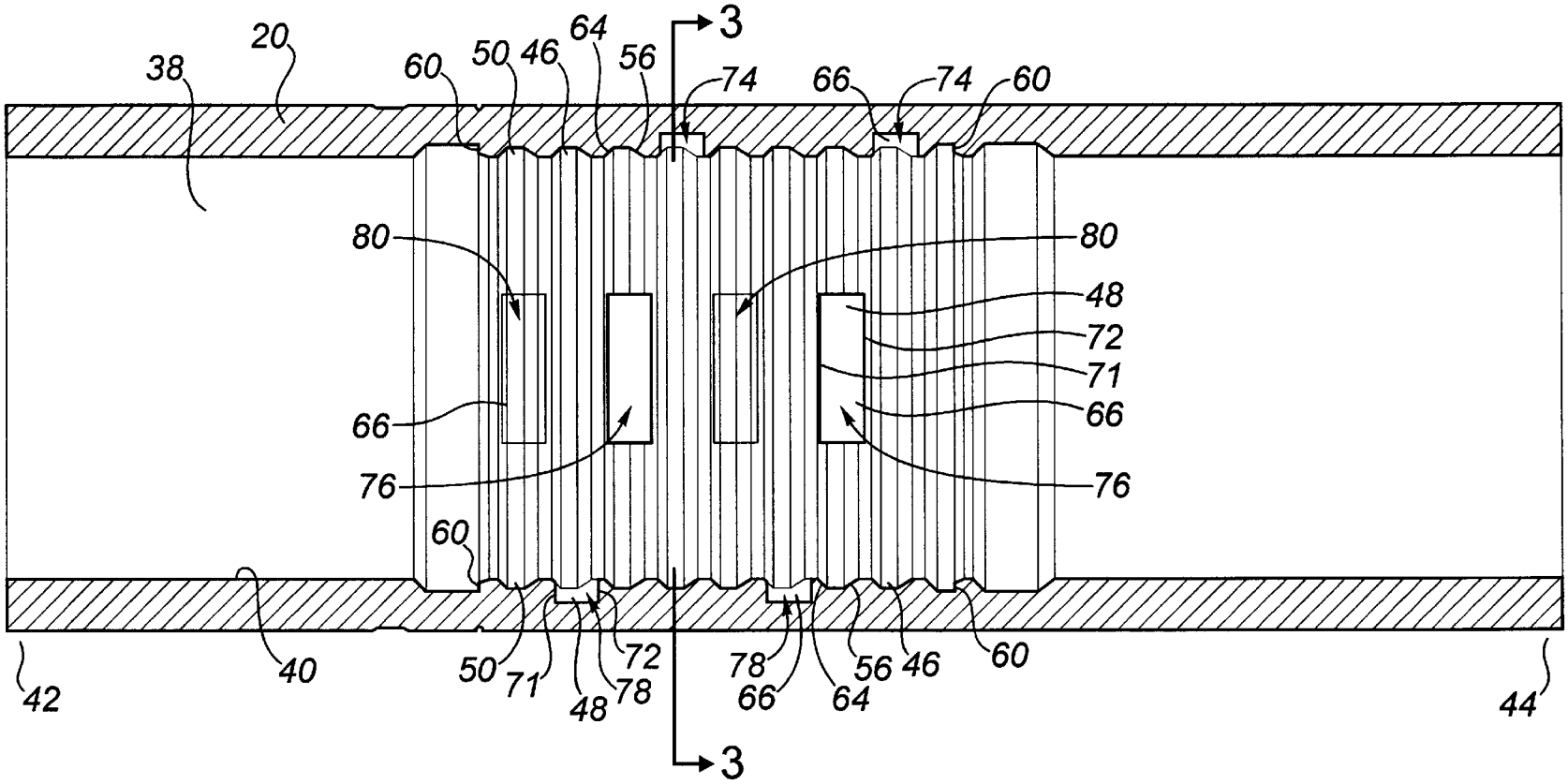
FIG. 1 is a pictorial view, partly in longitudinal section, of a preferred receiving member of the within invention for use in combination with a latch assembly, showing a first recessed area comprised of a plurality of grooves and showing a second recessed area comprised of a plurality of slots arranged in four positions.

Referring to FIGS. 1–5, the within invention is directed at a fail-safe apparatus for longitudinally supporting and rotationally orienting a well tool in a wellbore at a location beneath the ground surface. The apparatus is comprised of a receiving member (20) for containing in the wellbore at the desired location beneath the surface and a latch assembly (22) for connection with the tool. Further, the within invention is directed at an improved fail-safe receiving member (20) for use in combination with a latch assembly (22) to longitudinally support and rotationally orient the latch assembly (22) in the wellbore at the desired subsurface location. The latch assembly (22) is connectable with a well tool and may be passed through the wellbore to the location of the receiving member (20) in the wellbore. Thus, a description of the preferred apparatus necessarily includes a description of the preferred receiving member (20).

The apparatus of the within invention provided primarily to function as a fail-safe or safety device or mechanism. Specifically, the reviewing member (20) prevent the passage of a well tool fitted with the latch assembly (22) past or through the receiving member (20) such that the tool cannot be lost downhole. Thus, the latch assembly (22) may not be dropped or pushed through the receiving member (20). Further, the receiving member (20) is configured such that the latch assembly (22) is prevented from passing through it regardless of the orientation of the latch assembly (22) in the wellbore.

Once the latch assembly (22) is moved through the wellbore and received longitudinally within the receiving member (20) at the desired location beneath the surface, the latch assembly (22) and the tool connected therewith are longitudinally supported in the wellbore by the receiving member (20). As the receiving member (20) is located at a designed and pre-measured depth in the wellbore, the receipt of the latch assembly (22) in the receiving member (20) also acts as a depth indicator.

Further, the apparatus also preferably functions as an orienting mechanism. Specifically, once the latch assembly (22) is received longitudinally within the receiving member (20), the latch assembly (22) may be rotated relative to the receiving member (20) to orient the latch assembly (22), and thus the connected well tool, in a desired direction. In this regard, the receiving member (20) is configured such that the latch assembly (22) is inhibited from further rotation within the receiving member (20) once the latch assembly (22) achieves a designed and pre-measured orientation.

As the apparatus may be used to perform both a locating and an orienting function, the apparatus has been found to be of particular use in the drilling and production of lateral wellbores. In this case, a secondary, branch or lateral wellbore extends laterally from a primary or main wellbore. Such lateral wellbores are often drilled or produced through a gap or window in the casing or wall of the main wellbore. Thus, the receiving member (20) may be used to locate and orient the latch assembly (22) and the tool connected therewith relative to the window.

As stated, the apparatus is comprised of the latch assembly (22), while the improved receiving member (20) is for use in combination with the latch assembly (22). Any conventional latch assembly (22) compatible with the receiving member (20), as described herein, may be used. Further, the latch assembly (22) is capable of being run downhole through the wellbore to the desired location beneath the surface for receipt in the tubular receiving member (20). As well, the latch assembly (22) is connectable with a desired well tool in that the latch assembly (22) may either be attachable or fittable with a desired well tool or it may form an integral part of the well tool. Where the latch assembly (22) is attached or fitted with the well tool, the latch assembly (22) may be attached to the well tool by any conventional fasteners or mechanisms for attachment, such as by a threaded connection between the latch assembly (22) and the well tool. The latch assembly (22) and tool may be placed downhole using any conventional equipment or methods for placing tools downhole. For instance, the latch assembly (22) and tool may be lowered in the wellbore on a drill string.

Referring to FIGS. 5*a*–5*d*, the latch assembly (22) is comprised of at least one outwardly biased, radially movable latch member (24). However, preferably, the latch assembly (22) is comprised of two or more latch members (24). Any number of latch members (24) capable of securely or firmly engaging the receiving member (20) as described below may be used. In the preferred embodiment, the latch assembly (22) is comprised of four latch members (24), as shown in FIGS. 5*a*–5*d*.

In the preferred embodiment, with the exception of the number of latch members (24) comprising the latch assembly (22), the latch assembly (22) is comprised of a conventional latch assembly as shown and described in U.S. Pat. No. 5,579,829 issued Dec. 3, 1996 to Comeau et. al. Specifically, the improved receiving member (20) of the within invention may be used with the latch assembly of Comeau et. al. However, as stated, the latch assembly (22) of the within invention may be comprised of any number of latch members (24) other than the three latch members (24) shown in Comeau et. al. In particular, the preferred embodiment of the latch assembly (22) of the within invention is comprised of four latch members (24). As a result, in the preferred embodiment the specific pattern or contours of each latch member (24) differs somewhat from that described in Comeau et. al.

More particularly, in the preferred embodiment, the latch assembly (22) defines a longitudinal axis. Further, referring to FIGS. 5*a*–5*d*, each of the latch members (24) has a first end (26), an opposing second end (28) and a longitudinal axis extending therebetween. Further, each latch member (24) has an external surface (30), for engaging the receiving member (20), and an opposing internal surface (32). As well, the external surface (30) of each latch member (24) is comprised of a first contour (34) and a second contour (36), the purposes of which are further described below. In the preferred embodiment, the latch members (24) are spaced about the latch assembly (22) such that the longitudinal axes of the latch members (24) are substantially parallel with the longitudinal axis of the latch assembly (22). Further, the external surfaces (30) of the latch members (24) face outwards, away from the latch assembly (22), In addition, each of the latch members (24) is movably mounted or connected with the latch assembly (22) such that each latch member (24) is movable radially with respect to the latch assembly (22). In other words, each latch member (24) is reciprocally movable away from and towards the longitudinal axis of the latch assembly (22). Any conventional mechanism, apparatus or structure for movably mounting the latch members (24) in the described manner may be used. However, the latch members (24) must be capable of moving inwardly, towards the longitudinal axis of the latch assembly (22), for a sufficient distance to permit the latch assembly (22) to be moved through the wellbore and the receiving member (20) without damaging the latch members (24). Conversely, the latch members (24) must be capable of moving outwardly, away from the longitudinal axis of the latch assembly (22), for a sufficient distance to achieve the necessary engagement of the latch members (24) with the receiving member (20), as described below, to prevent longitudinal movement and to inhibit rotational movement of the latch assembly (22) relative to the receiving member (20).

As well, each of the latch members (24) is preferably outwardly biased. In other words, each of the latch members (24) tends to be urged away from the longitudinal axis of the latch assembly (22). Thus, when the latch assembly (22) is being passed through the wellbore to the location of the receiving member (20), the external surfaces (30) of the latch members (24) are urged towards the wellbore. When the latch assembly (22) is received in the receiving member (20), the external surfaces (30) of the latch members (24) are urged towards the receiving member (20). The latch members (24) may be outwardly biased by any conventional mechanism, apparatus or structure, such as by one or more springs acting against or upon the internal surfaces (32) of the latch members (24). Further, the specific urging mechanism is selected to provide a secure or firm engagement between the latch members (24) and the receiving member (20) when the latch members (24) are received therein.

The tubular receiving member (20) is containable within the wellbore at the desired location beneath the surface. As indicated previously, the location or depth of the receiving member (20) is preferably pre-selected or pre-measured so that the receiving member (20) may act as a depth locator when the latch assembly (22) is received therein. Further, as the receiving member (20) is configured to act as a fail-safe mechanism, and it will thus prevent any tool fitted with the latch assembly (22) from passing therethrough, the receiving member (20) is preferably located at the greatest depth downhole at which it is desired to locate and orient a well tool. For instance, the receiving member (20) of the within invention is preferably located downhole of the window or gap in the wellbore located the furthest from the surface.

Further, as indicated previously, the circumferential orientation of the receiving member (20) is also preferably pre-selected or pre-measured so that the orientation of the latch assembly (22) and the attached tool are known. For instance, the latch assembly (22) and the tool are typically oriented relative to the window or gap in the wellbore, and thus the lateral wellbore extending therefrom.

The tubular receiving member (20) may be comprised of any tubular structure capable of being placed within the wellbore and able to receive the latch assembly (22) therein. However, preferably, the receiving member (20) is associated with the casing of the wellbore such that the receiving member (20) is continuous therewith. Further, preferably, the receiving member (20) does not obstruct or otherwise interfere significantly with the passage of equipment or fluids through the casing during the drilling or production of the wellbore. For instance, the receiving member (20) may be comprised of a portion of the casing of the wellbore such that the receiving member (20) is integrally formed therewith. However, in the preferred embodiment, the receiving member (20) is comprised of a casing coupling connectable with the casing of the wellbore.

As shown in FIGS. 1–4, the receiving member (20) is tubular in configuration such that it defines a bore (38), having an internal surface (40), for receiving the latch assembly (22) therein. The bore (38) extends from a first end (42) to a second end (44) of the receiving member (20) and defines a longitudinal axis extending therethrough. When the latch assembly (22) is located within the receiving member (20), the external surfaces (30) of the latch members (24) are urged towards the internal surface (40) of the bore (38) of the receiving member (20).

Figure 4:
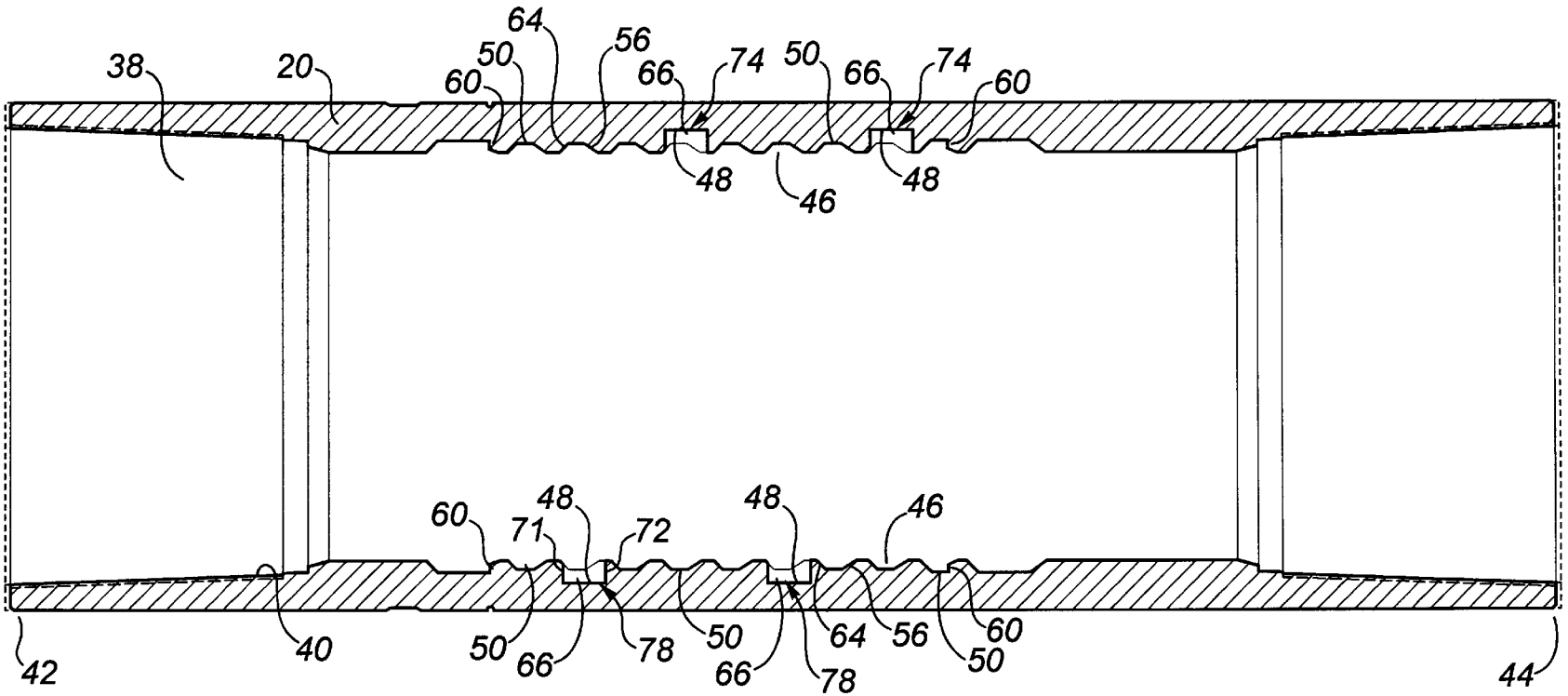
FIG. 4 is a longitudinal sectional view of the receiving member as shown in FIG. 1.

Referring to FIGS. 1 and 4, the internal surface (40) of the bore (38) of the receiving member (20) defines a first recessed area (46) and a second recessed area (48). The first and second recessed areas (46, 48) are specifically configured to align with and receive the latch members (24). More particularly, when aligned with the first and second recessed areas (46, 48), the latch members (24) move radially outward such that the external surfaces (30) of the latch members (24) move towards the internal surface (40) of the bore (38) of the receiving member (20) within the recessed areas (46, 48).

The first recessed area (46) defines a first increased radial distance between the longitudinal axis of the receiving member (20) and the portion of the internal surface (40) of the bore (38) defining the first recessed area (46). The first recessed area (46) is configured so that upon the longitudinal alignment of the latch member (24) and the first recessed area (46), the latch member (24) moves radially outward, as a result of the increased radial distance, and is received in the first recessed area (46) to support the latch assembly (22) longitudinally. Further, the first recessed area (46) is configured such that once the latch assembly (22) is supported longitudinally in the receiving member (20), further longitudinal movement of the latch assembly (22) relative to the receiving member (20) in a downward direction, away from the ground surface or further downhole, is prevented.

As well, in order that the latch assembly (22) may be oriented within the receiving member (20) once it is longitudinally supported thereby, the first recessed area (46) is configured to permit the rotation of the latch assembly (22) relative to the receiving member (20) when the latch members (24) are received in the first recessed area (46).

The first recessed area (46) may have any shape or configuration having the above-noted characteristics or which is capable of performing the above-noted functions or purposes. However, in the preferred embodiment, the first recessed area (46) extends circumferentially about the entire bore (38) of the receiving member (20) so that the latch assembly (22) is capable of rotation relative to the receiving member (20) when the latch members (24) is received in the first recessed area (46).

More particularly, referring to FIGS. 1 and 4, the first recessed area (46) is preferably comprised of at least one groove (50) defined by the bore (38) of the receiving member (20) extending about the entire circumference of the bore (38). However, the first recessed area (46) may be comprised of any number of grooves (50) as required to be compatible with the latch members (24) and the pattern or contours of the external surfaces (30) thereof.

As stated above, the external surface (30) of each latch member (24) is comprised of a first contour (34). The first recessed area (46), and in particular the grooves (50), are configured to be compatible with the first contour (34) of each latch member (24) such that the first contour (34) is received in the first recessed area (46) and longitudinal movement of the latch member (24) relative to the receiving member (20) in a downward direction, away from the surface or further downhole, is prevented when the latch member (24) is received in the first recessed area (46).

The first contour (34) of each latch member (24) may have any shape or configuration having the above-noted characteristics or which is capable of performing the above-noted functions or purposes. However, as shown in FIGS. 5*a*–5*d*, in the preferred embodiment, the external surface (30) of each latch member (24) defines at least one, and preferably a plurality, of projections (52) or protrusions extending away from the external surface (30) for engagement with the receiving member (20). Preferably, the projections (52) comprise the first contour (34) for preventing the downward movement of the latch member (24) relative to the receiving member (20). More particularly, each of the projections (52) has a downwardly directed shoulder (54). At least one of the downwardly directed shoulders (54) of the latch member (24) is configured to prevent the downward movement of the latch member (24) relative to the receiving member (20).

Further, as stated, the first recessed area (46) is compatible with the first contour (34), and thus, is compatible with the projections (52) and the downwardly directed shoulders (54) of the latch members (24). Thus, the first recessed area (46) is preferably comprised of at least one upwardly directed shoulder (56) for engaging at least one downwardly directed shoulder (54) of the latch member (24) upon receipt of the latch member (24) in the first recessed area (46). More particularly, at least one of the grooves (50) defined by the first recessed area (46) preferably includes or defines the upwardly directed shoulder (56).

The downwardly directed shoulders (54) of the latch member (24) and the upwardly directed shoulders (56) of the first recessed area (46) may have any shape or configuration so long as the engagement of at least one downwardly directed shoulder with a corresponding upwardly directed shoulder prevents longitudinal movement of the latch member (24) in a direction downhole relative to the receiving member (20). However, preferably, at least one downwardly directed shoulder (54) of the latch member (24) is substantially square (58) in shape and at least one corresponding upwardly directed shoulder (56) of the first recessed area (46) is substantially square (60) in shape. As a result, when the latch member (24) is received in the first recessed area (46), the square downwardly directed shoulder (58) engages the square upwardly directed shoulder (60) to prevent longitudinal movement of the latch member (24) relative to the receiving member (20).

Referring to FIGS. 5*a*–5*d*, in the preferred embodiment, each latch member (24) includes five projections (52), each having a downwardly directed shoulder (54). Of these downwardly directed shoulders (54), two are square (58) in shape and are located adjacent or in proximity to the first and second ends (26, 28) of the latch member (24) respectively as shown in FIGS. 5*a*–5*d*. However, any other location compatible with their intended function may be used. Further, the locations of the square downwardly directed shoulders (58) are the same on each of the latch members (24). Similarly, referring to FIGS. 1 and 4, in the preferred embodiment, the grooves (50) of the first recessed area (46) corresponding to the locations of the square downwardly directed shoulders (58) of the latch member (24) define compatible square upwardly directed shoulders (60) for engagement therewith.

Referring to FIGS. 5*a*–5*d*, each of the projections (52) also has an upwardly directed shoulder (62) opposite the downwardly directed shoulder (54). As well, referring to FIGS. 1 and 4, each of the grooves (50) of the first recessed area (46) also has a downwardly directed shoulder (64) opposite the upwardly directed shoulder (56). Preferably, the upwardly directed shoulder (62) of the latch member (24) and the corresponding downwardly directed shoulder (64) of the first recessed area (46) are compatibly tapered or sloped so that the latch assembly (22) may be moved in an upward direction towards the surface relative to the receiving member (20) when the latch member (24) is received in the first recessed area (46). Specifically, as a force is applied to the latch assembly (22) in an upwards direction, the upwardly directed shoulder (62) of the latch member (24) moves along the downwardly directed shoulder (64) of the first recessed area (46), which causes the latch member (24) to move radially inward so permit the longitudinal movement of the latch assembly (22) relative to the receiving member (20). This design is preferable where the removal of the latch assembly (22), and the tool connected therewith, from the wellbore is either required or is otherwise desirable.

Referring to FIGS. 1–4, the internal surface (40) of the bore (38) of the tubular receiving member (20) also defines the second recessed area (48). The second recessed area (48) is accessible by the latch member (24) from the first recessed area (46). In other words, the latch member (24) is permitted access to the second recessed area (48) when it is received in the first recessed area (46). As a result, the latch assembly (22) may be oriented within the receiving member (20) once it is longitudinally supported by the first recessed area (46).

The second recessed area (48) defines a second increased radial distance between the longitudinal axis of the receiving member (20) and the portion of the internal surface (40) of the bore (38) defining the second recessed area (48). Further, the second recessed area (48) is configured so that the second increased radial distance is greater than the first increased radial distance of the first recessed area (46). Further, the second recessed area (48) is configured so that upon the rotational alignment of the latch member (24) and the second recessed area (48), the latch member (24) moves radially outward, as a result of the second increased radial distance, and is received in the second recessed area (48) to orient the latch assembly (22) rotationally. Further, the second recessed area (48) is configured such that once the latch assembly (22) is rotationally oriented relative to the receiving member (20) in the pre-measured direction or orientation, further rotation of the latch assembly relative to the receiving member (20) is inhibited.

In addition, upon the rotational alignment of the latch members (24) with the second recessed area (48) and receipt of the latch members (24) therein, the engagement of the square downwardly directed shoulder (58) of the latch members (24) and the square upwardly directed shoulders (60) of the first recessed area (46) may be enhanced in order to facilitate or further provide for the longitudinal support of the latch assembly (22) in the receiving member (20). For instance, the area of contact between the square downwardly directed shoulder (58) of the latch members (24) and the square upwardly directed shoulders (60) of the first recessed area (46) may be increased.

The second recessed area (48) may have any shape or configuration having the above-noted characteristics or which is capable of performing the above-noted functions or purposes. However, in the preferred embodiment, the second recessed area (48) extends circumferentially about a portion of the bore (38) of the receiving member (20) such that when the latch member (24) is received in the first recessed area (46) the latch assembly (22) may be rotated relative to the receiving member (20) to align the latch member (24) rotationally with the second recessed area (48).

More particularly, referring to FIGS. 1–4, the second recessed area (48) is preferably comprised of at least one slot (66) defined by the bore (38) of the receiving member (20) extending only partially about the circumference of the bore (38). However, the second recessed area (48) may be comprised of any number of slots (66) as required to be compatible with the latch members (24) and the pattern or contours of the external surfaces (30) thereof.

As stated above, the external surface (30) of each latch member (24) is also comprised of a second contour (36). The second recessed area (48), and in particular the slots (66), are configured to be compatible with the second contour (36) of each latch member (24) such that the second contour (36) is receivable in the second recessed area (48) and rotational movement of the latch member (24) relative to the receiving member (20) is inhibited when the latch member (24) is received in the second recessed area (48).

The second contour (36) of each latch member (24) may have any shape or configuration having the above-noted characteristics or which is capable of performing the above-noted functions or purposes. However, as stated above and as shown in FIGS. 5*a*–5*d*, in the preferred embodiment, the external surface (30) of each latch member (24) defines at least one, and preferably a plurality, of the projections (52) for engagement with the receiving member (20). Preferably, the projections (52) comprise the second contour (36) for preventing the rotational movement of the latch member (24) relative to the receiving member (20) once the latch member (24) is aligned with the second recessed area (48). More particularly, each of the projections (52) has a pair of opposing sidewardly directed latch shoulders (68). The sidewardly directed latch shoulders (68) of at least one of the projections (52) of the latch member (24) are configured to inhibit the rotational movement of the latch member (24) relative to the receiving member (20).

Figure 3:
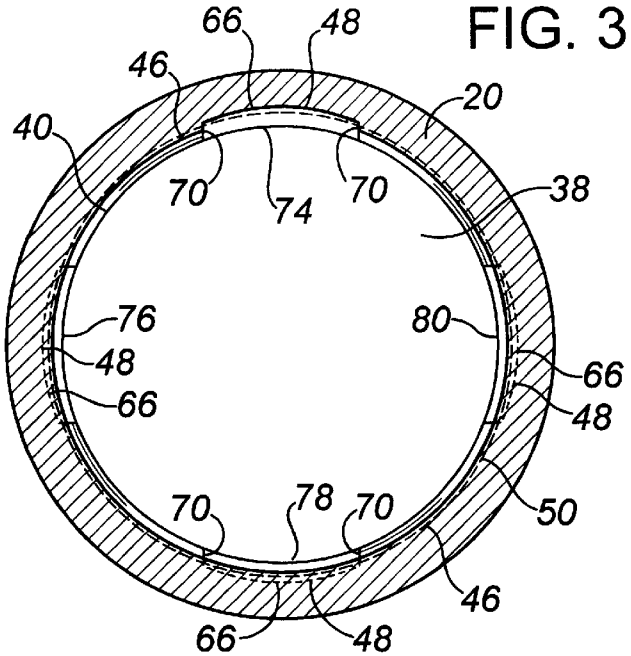
FIG. 3 is a cross-sectional view of the receiving member taken along line 3—3 of FIG. 1.

Further, as stated, the second recessed area (48) is compatible with the second contour (36), and thus, is compatible with the projections (52) and the sidewardly directed latch shoulders (68). Thus, as shown in FIG. 3, the second recessed area (48) is preferably comprised of a compatible pair of sidewardly directed recess shoulders (70) for engaging at least one pair of the sidewardly directed latch shoulders (68) upon receipt of the latch member (24) in the second recessed area (48). More particularly, at least one of the slots (66) defined by the second recessed area (48) preferably includes or defines the sidewardly directed recess shoulders (70).

The sidewardly directed latch shoulders (68) and the corresponding sidewardly directed recess shoulders (70) may have any shape or configuration so long as the engagement of at least one pair of sidewardly directed latch shoulders (68) with a corresponding pair of sidewardly directed recess shoulders (70) inhibits rotational movement of the latch member (24) relative to the receiving member (20). For instance, the sidewardly directed latch and recess shoulders (68, 70) may be tapered or sloped such that rotational movement is inhibited, but not completely prevented. However, although the rotational movement need only be inhibited in order to orient the latch assembly (22) and the connected tool, the shoulders (68, 70) may be configured, where required or desired, to completely prevent any relative rotational movement of the latch assembly (22) and the receiving member (20) when the latch member (24) is aligned with the slots (66).

Preferably, at least one pair of sidewardly directed latch shoulders (68) are substantially square in shape and at least one corresponding pair of sidewardly directed recess shoulders (70) are substantially square in shape. As a result, when the latch member (24) is received in the second recessed area (48), the square sidewardly directed latch shoulders (68) engages the square sidewardly directed recess shoulders (70) to prevent rotational movement of the latch member (24) relative to the receiving member (20). Referring to FIGS. 5*a*–5*d*, in the preferred embodiment, each projection (52) of the latch member (24) has square sidewardly directed latch shoulders (68). Similarly, referring to FIG. 3, in the preferred embodiment, the slots (66) of the second recessed area (48) each define compatible square sidewardly directed recess shoulders (70) for engagement therewith.

Figure 2:
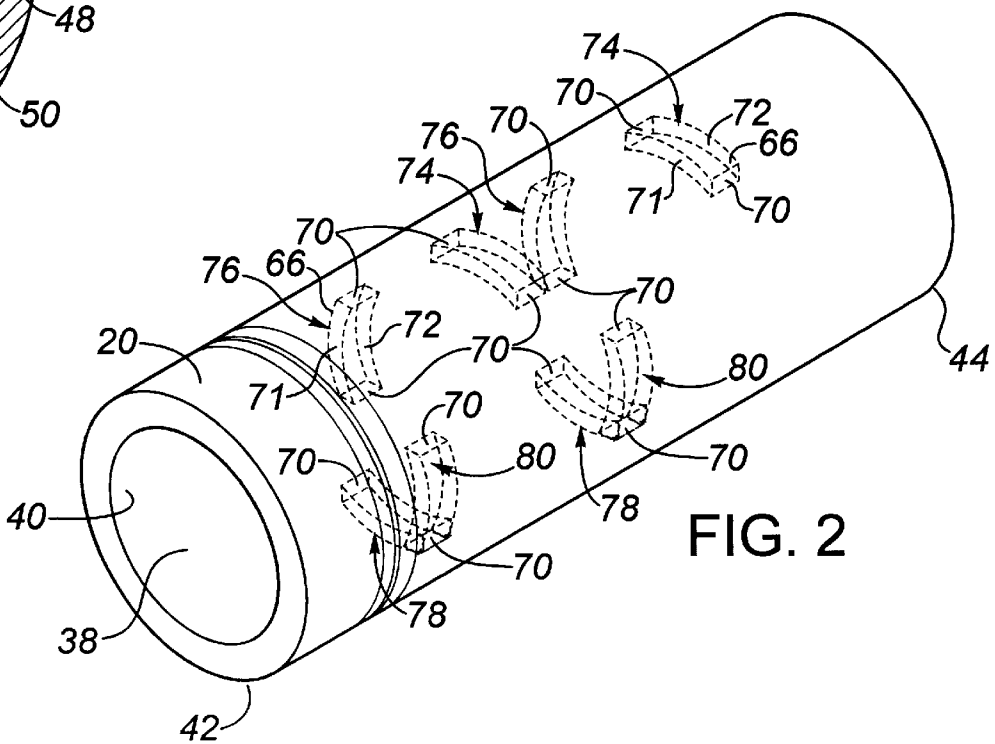
FIG. 2 is a pictorial view of the receiving member shown in FIG. 1, showing the four slot positions of the second recessed area in greater detail.

Further, in addition to the sidewardly directed recess shoulders (70), each slot (66) includes an upper surface (71) and a lower surface (72) as shown in FIGS. 1, 2 and 4. The upper and lower surfaces (71, 72) may have any shape or configuration. For instance, the upper and lower surfaces (71, 72) may be sloped or tapered. However, in the preferred embodiment, as shown in FIGS. 1, 2 and 4, the upper and lower surfaces (71, 72) are also substantially square in shape.

Where the latch assembly (22) is comprised of a plurality of latch members (24), as in the preferred embodiment, the latch members (24) are further configured on the latch assembly (22) in a pattern. In the preferred embodiment, the latch members (24) are about equidistantly spaced about the latch assembly (22). Further, in this instance, the second recessed area (48) is configured to be compatible with the pattern of the latch members (24) so that the rotational alignment of one latch member (24) with the second recessed area (48) will result in the rotational alignment of all of the latch members (24) with the second recessed area (48). In the preferred embodiment as shown in FIG. 3, the slots (66) comprising the second recessed area (48) are thus about equidistantly spaced about the bore (38) of the receiving member (20) to align with or complement the pattern of the latch members (24).

Further, the projections (52) on the latch members (24) are preferably configured in a further pattern, compatible with a complementary pattern of slots (66) formed in the bore (38) of the receiving member (20), so that the rotational alignment of the latch members (24) with the second recessed area (48), and in particular the slots (66), may be achieved at a single rotational orientation of the latch assembly (22) relative to the receiving member (20).

More particularly, in the preferred embodiment, at least one of the projections (52) on each latch member (24) acts as, or performs the function of, an orienting projection (73). The location or pattern of the orienting projection (73) or projections (73) on each latch member (24) differs from the location or pattern of the orienting projection (73) or projections (73) on each of the other latch members (24). In the preferred embodiment, each of the latch members (24) has two orienting projections (73) which are located in the pattern illustrated in FIGS. 5*a*–5*d* for each of the four latch members (24) respectively. The second recessed area (48), and in particular the slots (66), are configured to be compatible with the latch members (24) such that the orienting projections (73) are receivable therein. Further, the slots (66) are configured so that the rotational alignment of the orienting projections (73) of one latch member (24) with the corresponding slots (66) will result in the rotational alignment of all of the latch members (24) with their respective corresponding slots. Finally, the slots (66) are configured so that the rotational alignment of the orienting projections (73) with the slots (66) may only be achieved at a single rotational orientation of the latch assembly (22) relative to the receiving member (20).

Figure 5D:
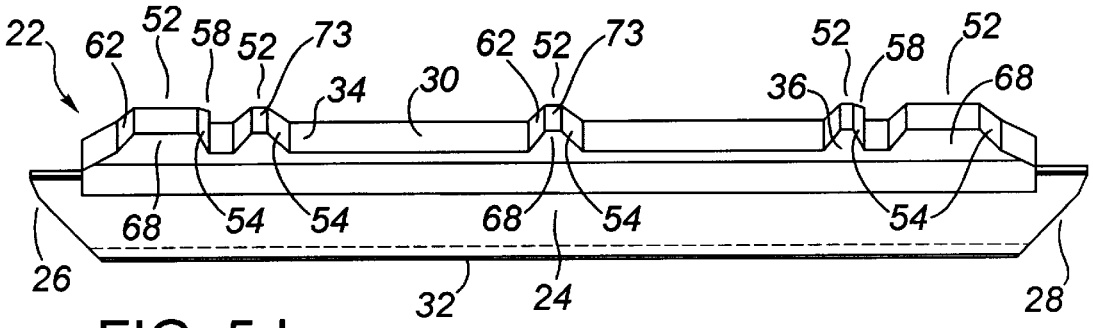
FIGS. 5*a*, 5*b*, 5*c* and 5*d* are pictorial views of four latch members comprising the preferred latch assembly of the within invention, showing the external surfaces of the latch members in detail.
Figure 5C:
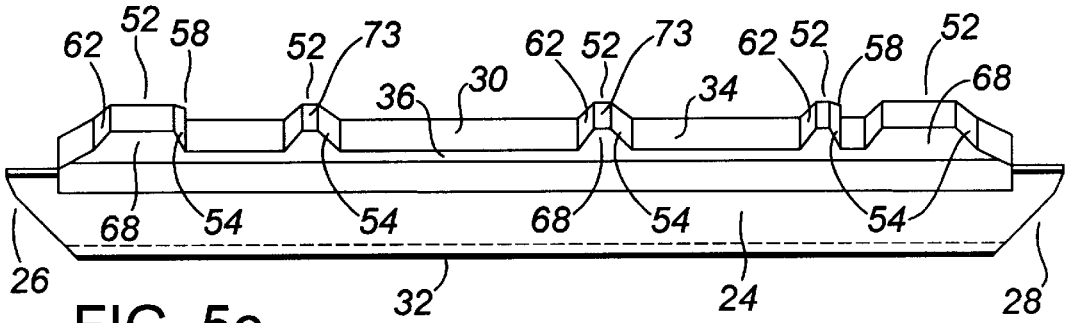
Figure 5B:
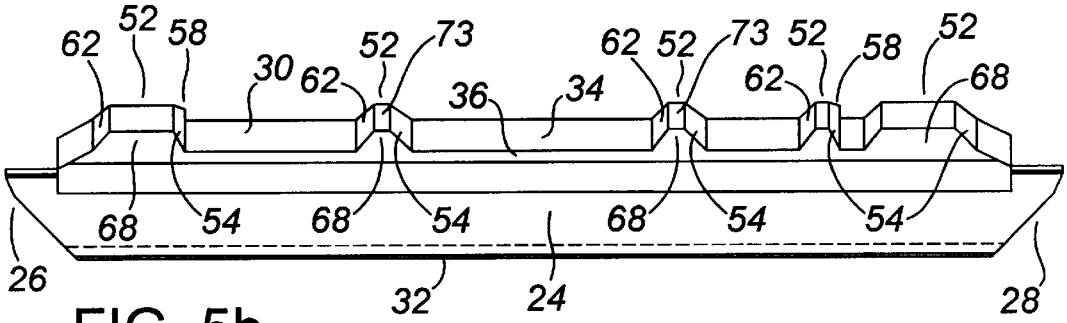
Figure 5A:
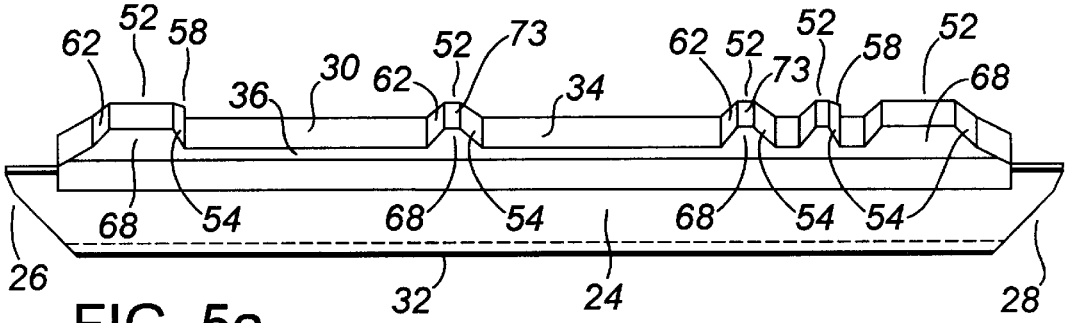

In the preferred embodiment, the slots (66) are configured in a compatible pattern with the latch members (24) as illustrated in FIGS. 1–3. More particularly, the second recessed area (48) is comprised of four slot positions (74, 76, 78, 80) compatible with the latch members shown in FIGS. 5*a*, 5*b*, 5*c* and 5*d* respectively. As a result, upon the rotational alignment of the latch members (24) with the second recessed area (48) at the pre-selected or pre-measured orientation of the latch assembly (22) relative to the receiving member (20), the latch member (24) shown in FIG. 5*a* is received in slot position one (74), the latch member (24) shown in FIG. 5*b* is received in slot position two (76), the latch member (24) shown in FIG. 5*c* is received in slot position three (78) and the latch member (24) shown in FIG. 5*d* is received in slot position four (80).

To use the within invention, the receiving member (20) is placed in the wellbore at a pre-determined and pre-measured depth in the wellbore. The latch assembly (22) is then lowered through the wellbore longitudinally to the location of the receiving member (20) where the latch assembly (22) is received within the bore (38) of the receiving member (20). Upon further movement of the latch assembly (22) in a downward direction, the latch members (24) of the latch assembly (22) are longitudinally aligned with the grooves (50) comprising the first recessed area (46). Upon the longitudinal alignment of the latch members (24) and the first recessed area (46), the latch members (24) move radially outward and are received in the first recessed area (46) as a result of the first increased radial distance of the first recessed area (46) in order to support the latch assembly (22) longitudinally such that further longitudinal movement of the latch assembly (22) relative to the receiving member (20) in a downward direction away from the surface is prevented. More particularly, the further longitudinal movement is prevented by the engagement of the square downwardly directed shoulders (58) of the latch members (24) with the square upwardly directed shoulders (60) of the first recessed area (46). Typically, the engagement of the latch members (24) with the grooves (50) will be detectable at the surface as further downward movement will be prevented despite an increase in the force being applied.

Once the latch members (24) are longitudinally aligned with the first recessed area (46), the latch assembly (22) is rotated about its longitudinal axis within the receiving member (20) until such time that the latch members (24) are rotationally aligned with the slots (66) comprising the second recessed area (48). Upon the rotational alignment of the latch members (24) with the second recessed area (48), the latch members (24) move further radially outward and are received in the second recessed area (48) as a result of the second increased radial distance of the second recessed area (48) in order to orient the latch assembly (22) rotationally such that rotation of the latch assembly (22) relative to the receiving member (20) is inhibited. More particularly, further rotational movement is inhibited by the engagement of the sidewardly directed latch shoulders (68) of the latch members (24) with the sidewardly directed recess shoulders (70) of the second recessed area (48). Typically, the engagement of the latch members (24) and the slots (66) will be detected at the surface by a sharp increase in the amount of torque being applied to rotate the latch assembly (22).

In order to remove the latch assembly (22) from the receiving member (20), a force is applied to the latch assembly (22) in an upwards direction. As a result, the upwardly directed shoulders (62) of the latch member (24) move along the downwardly directed shoulders (64) of the first recessed area (46) and the upper surface (71) of the slots (66) of the second recessed area (48), which causes the latch member (24) to move radially inward to permit the longitudinal movement of the latch assembly (22) relative to the receiving member (20). Any conventional apparatus or process may be used for removing the latch assembly (22), and the tool connected therewith, from the wellbore.

The embodiments of the invention in which an exclusive privilege or property is claimed are defined as follows:

1. A fail-safe tubular receiving member for use in combination with a latch assembly to longitudinally support and rotationally orient the latch assembly in a wellbore at a location beneath the surface, the latch assembly comprising at least one outwardly biased, radially movable latch member having an external surface and the tubular receiving member defining a bore having an internal surface for receiving the latch assembly therein and a longitudinal axis extending therethrough, wherein the improvement comprises:

(a) a first contour defined by the external surface of the latch member;

(b) a first recessed area defined by the internal surface of the bore of the receiving member, wherein the first recessed area defines a first increased radial distance between the longitudinal axis of the receiving member and the first recessed area and wherein the first recessed area is configured so that upon longitudinal alignment of the latch member and the first recessed area, the latch member moves radially outward and is received in the first recessed area to support the latch assembly longitudinally and wherein the first recessed area is compatible with the first contour such that longitudinal movement of the latch member relative to the receiving member in a downward direction away from the surface is prevented when the latch member is received in the first recessed area; and (c) a second recessed area defined by the internal surface of the bore of the receiving member and accessible by the latch member from the first recessed area, wherein the second recessed area defines a second increased radial distance between the longitudinal axis of the receiving member and the second recessed area which is greater than the first increased radial distance and wherein the second recessed area is configured so that upon rotational alignment of the latch member and the second recessed area, the latch member moves radially outward and is received in the second recessed area to orient the latch assembly rotationally such that rotation of the latch assembly relative to the receiving member is inhibited.

2. The receiving member as claimed in claim 1 wherein the first recessed area extends circumferentially about the entire bore of the receiving member so that the latch assembly is capable of rotation relative to the receiving member when the latch member is received in the first recessed area.

3. The receiving member as claimed in claim 2 wherein the second recessed area extends circumferentially about a portion of the bore of the receiving member such that when the latch member is received in the first recessed area the latch assembly may be rotated relative to the receiving member to align the latch member rotationally with the second recessed area.

4. The receiving member as claimed in claim 3 wherein the first recessed area is comprised of at least one groove defined by the bore of the receiving member extending about the entire circumference of the bore.

5. The receiving member as claimed in claim 3 wherein the second recessed area is comprised of at least one slot defined by the bore of the receiving member extending only partially about the circumference of the bore.

6. The receiving member as claimed in claim 4 wherein the second recessed area is comprised of at least one slot defined by the bore of the receiving member extending only partially about the circumference of the bore.

7. The receiving member as claimed in claim 6 wherein the first contour is comprised of a downwardly directed shoulder on the latch member, and wherein the first recessed area is comprised of an upwardly directed shoulder in the first recessed area for engagement with the downwardly directed shoulder of the latch member upon receipt of the latch member in the first recessed area.

8. The receiving member as claimed in claim 7 wherein the downwardly directed shoulder of the latch member is substantially square and wherein the upwardly directed shoulder of the first recessed area is substantially square so that when the latch member is received in the first recessed area the downwardly directed shoulder engages the upwardly directed shoulder to prevent longitudinal movement of the latch member relative to the receiving member.

9. The receiving member as claimed in claim 8 wherein the external surface of the latch member is comprised of a second contour and wherein the second recessed area is compatible with the second contour such that rotational movement of the latch member relative to the receiving member is inhibited when the latch member is received in the second recessed area.

10. The receiving member as claimed in claim 9 wherein the second contour is comprised of sidewardly directed latch shoulders on the latch member, and wherein the second recessed area is comprised of sidewardly directed recess shoulders in the second recessed area.

11. The receiving member as claimed in claim 10 wherein the sidewardly directed latch shoulders of the latch member are substantially square and wherein the sidewardly directed recess shoulders of the second recessed area are substantially square so that when the latch member is received in the second recessed area the sidewardly directed latch shoulders engage the sidewardly directed recess shoulders to inhibit rotational movement of the latch member relative to the receiving member.

12. The receiving member as claimed in claim 11 wherein the latch assembly is comprised of a plurality of latch members, wherein the plurality of latch members are configured on the latch assembly in a pattern and wherein the second recessed area is configured to be compatible with the pattern of latch members so that rotational alignment of one latch member with the second recessed area will result in rotational alignment of all of the latch members with the second recessed area.

13. The receiving member as claimed in claim 12 wherein rotational alignment of the latch members with the second recessed area is achieved at a single rotational orientation of the latch assembly relative to the receiving member.

14. A fail-safe apparatus for longitudinally supporting and rotationally orienting a well tool in a wellbore at a location beneath the surface, comprising:

(a) a latch assembly for connection with the tool, the latch assembly comprising at least one outwardly biased, radially movable latch member having an external surface and wherein the external surface is comprised of a first contour;

(b) a tubular receiving member for containing within the wellbore at the location beneath the surface, wherein the tubular receiving member defines a bore for receiving the latch assembly therein, wherein the bore defines a longitudinal axis extending therethrough and wherein the bore has an internal surface;

(c) a first recessed area defined by the internal surface of the bore of the receiving member, wherein the first recessed area defines a first increased radial distance between the longitudinal axis of the receiving member and the first recessed area and wherein the first recessed area is configured so that upon longitudinal alignment of the latch member and the first recessed area, the latch member moves radially outward and is received in the first recessed area to support the latch assembly longitudinally and wherein the first recessed area is compatible with the first contour such that longitudinal movement of the latch member relative to the receiving member in a downward direction away from the surface is prevented when the latch member is received in the first recessed area; and (d) a second recessed area defined by the internal surface of the bore of the receiving member and accessible by the latch member from the first recessed area, wherein the second recessed area defines a second increased radial distance between the longitudinal axis of the receiving member and the second recessed area which is greater than the first increased radial distance and wherein the second recessed area is configured so that upon rotational alignment of the latch member and the second recessed area, the latch member moves radially outward and is received in the second recessed area to orient the latch assembly rotationally such that rotation of the latch assembly relative to the receiving member is inhibited.

15. The apparatus as claimed in claim 14 wherein the first recessed area extends circumferentially about the entire bore of the receiving member so that the latch assembly is capable of rotation relative to the receiving member when the latch member is received in the first recessed area.

16. The apparatus as claimed in claim 15 wherein the second recessed area extends circumferentially about a portion of the bore of the receiving member such that when the latch member is received in the first recessed area the latch assembly may be rotated relative to the receiving member to align the latch member rotationally with the second recessed area.

17. The apparatus as claimed in claim 16 wherein the first recessed area is comprised of at least one groove defined by the bore of the receiving member extending about the entire circumference of the bore.

18. The apparatus as claimed in claim 16 wherein the second recessed area is comprised of at least one slot defined by the bore of the receiving member extending only partially about the circumference of the bore.

19. The apparatus as claimed in claim 17 wherein the second recessed area is comprised of at least one slot defined by the bore of the receiving member extending only partially about the circumference of the bore.

20. The apparatus as claimed in claim 19 wherein the first contour is comprised of a downwardly directed shoulder on the latch member, and wherein the first recessed area is comprised of an upwardly directed shoulder in the first recessed area for engagement with the downwardly directed shoulder of the latch member upon receipt of the latch member in the first recessed area.

21. The apparatus as claimed in claim 20 wherein the downwardly directed shoulder of the latch member substantially square and wherein the upwardly directed shoulder of the first recessed area is substantially square so that when the latch member is received in the first recessed area the downwardly directed shoulder engages the upwardly directed shoulder to prevent longitudinal movement of the latch member relative to the receiving member.

22. The apparatus as claimed in claim 21 wherein the external surface of the latch member is comprised of a second contour and wherein the second recessed area is compatible with the second contour such that rotational movement of the latch member relative to the receiving member is inhibited when the latch member is received in the second recessed area.

23. The apparatus as claimed in claim 22 wherein the second contour is comprised of sidewardly directed latch shoulders on the latch member, and wherein the second recessed area is comprised of sidewardly directed recess shoulders in the second recessed area.

24. The apparatus as claimed in claim 23 wherein the sidewardly directed latch shoulders of the latch member are substantially square and wherein the sidewardly directed recess shoulders of the second recessed area are substantially square so that when the latch member is received in the second recessed area the sidewardly directed latch shoulders engage the sidewardly directed recess shoulders to inhibit rotational movement of the latch member relative to the receiving member.

25. The apparatus as claimed in claim 24 wherein the latch assembly is comprised of a plurality of latch members, wherein the plurality of latch members are configured on the latch assembly in a pattern and wherein the second recessed area is configured to be compatible with the pattern of latch members so that rotational alignment of one latch member with the second recessed area will result in rotational alignment of all of the latch members with the second recessed area.

26. The apparatus as claimed in claim 25 wherein rotational alignment of the latch members with the second recessed area is achieved at a single rotational orientation of the latch assembly relative to the receiving member.

* * * * *